US007006053B2

(12) United States Patent
Zigler et al.

(10) Patent No.: US 7,006,053 B2
(45) Date of Patent: Feb. 28, 2006

(54) ADJUSTABLE REFLECTOR SYSTEM FOR FIXED DIPOLE ANTENNA

(75) Inventors: Robert Zigler, Marysville, WA (US); For Sander Lam, Bothell, WA (US)

(73) Assignee: Intermec IP Corp., Everett, WA (US)

( * ) Notice: Subject to any disclaimer, the term of this patent is extended or adjusted under 35 U.S.C. 154(b) by 0 days.

(21) Appl. No.: 10/429,105

(22) Filed: May 1, 2003

(65) Prior Publication Data

US 2004/0217908 A1 Nov. 4, 2004

(51) Int. Cl.
*H01Q 1/12* (2006.01)

(52) U.S. Cl. ..... 343/878; 343/793

(58) Field of Classification Search ..... 343/878, 343/880, 882, 793

See application file for complete search history.

(56) References Cited

U.S. PATENT DOCUMENTS 3,897,294 A * 7/1975 MacTurk ..... 156/245
4,663,632 A 5/1987 Budrow et al.
4,983,988 A 1/1991 Franke
5,389,941 A 2/1995 Yu
5,469,181 A 11/1995 Yarsunas
5,532,707 A 7/1996 Klinger et al.
5,554,998 A * 9/1996 Sherwood et al. ..... 343/881
5,867,130 A 2/1999 Tay et al.
6,198,460 B1 3/2001 Brankovic
6,466,181 B1 * 10/2002 Ho et al. ..... 343/882
6,734,830 B1 * 5/2004 Bickham ..... 343/880

* cited by examiner

*Primary Examiner*—Shih-Chao Chen
(74) *Attorney, Agent, or Firm*—Paul A. Maltseft

(57) ABSTRACT

An adjustable reflector system for fixed dipole antenna comprising of reflector and several supporting devices is described. The beam direction of the antenna can be changed by rotating the reflector about the Y-axis and/or adjusting the reflector about X axis and Z-axis. Such adjustments allow the user to fine tune the antenna to meet new or unforeseen coverage issues. The plurality of the of the reflector's shapes is disclosed (flat, curved, etc.).

2 Claims, 10 Drawing Sheets

ADJUSTABLE REFLECTOR SYSTEM FOR FIXED DIPOLE ANTENNA

BACKGROUND OF THE INVENTION

1. Field of the Invention

The present invention generally relates to a directional radio antenna, and more particularly, to a directional dipole antenna with adjustable reflector.

2. Description of Related Art

An antenna is a resonant device that transmits and/or receives electromagnetic waves. Electromagnetic waves are often referred to as radio waves. An antenna must be tuned to the same frequency band that the radio system to which it is connected; otherwise, reception and/or transmission will be impaired. The antenna size regularly refers as relative to wavelength. For example: a half-wave dipole, which is approximately a half-wavelength long. Wavelength is the distance a radio wave will travel during one cycle.

Gain and directivity are intimately related in antennas. The directivity of an antenna is defining a radiation of the RF energy directionally. It is quite intuitive that if the amount of radiating RF energy remains the same, but is distributed over less area, the apparent signal strength is higher in some particular direction. In another words, the directivity is the ability of an antenna to focus energy in a particular direction when transmitting or receiving energy. The attained increase in signal strength is the antenna gain. The gain is measured in decibels over either a dipole or a theoretical construct called an isotropic radiator. The qualitative relation between gain and directionality can be defined as gain=efficiency/directivity, where the antenna efficiency takes into account losses associated with the antenna structure and input terminals.

Another important characteristic of the antenna is a beamwidth, which characterizes the directivity of the antenna. The beamwidth is typically measured between the −3 dB points, i.e. the points on the main lobe where the signal strength drops off −3 dB (one-half) from the maximum signal point. The gain of the antenna is inversely proportional to the beam width: the narrower the beamwidth the higher the gain.

The antennas usually classified by the radiation characteristics on omnidirectional and directional antennas. Radio antennas produce a three-dimensional radiation pattern; however, for the description of the present invention it will be enough to analyze two-dimensional patterns from top or side projections. In the discussions below we will assume four different signals (A, B, C, D) arriving from different directions. In actual situations, of course, the signals will arrive from any direction, but we need to keep our discussion simplified.

The omnidirectional antenna radiates or receives electromagnetic waves equally well in all directions and does not favor any particular direction. One way to view the omnidirectional pattern is that it is a slice taken horizontally through the three dimensional sphere. FIG. 1 shows the pattern 102 for an omnidirectional antenna 101, with four cardinal signals. This type of pattern is commonly associated with verticals, ground planes and other antenna types in which the radiator element is vertical with respect to the Earth's surface. The key factor to note is that for receivers all four signals (or signals from any direction, from A, B, C, and D directions) are received equally well. For transmitters, the radiated signal has also the same strength in all directions.

Directional antennas focus energy in a particular direction. Directional antennas are primary used in applications where the coverage is preferable over some particular sector, and when one site needs to connect to only one other site or to multiple sites in same directional line, and omnidirectional coverage is not required. For example, point-to-point links are benefit from using directional antennas because it will minimize interference and maximize communications distance between these two sites. FIG. 2 shows the beam pattern 204 for antenna with a reflector and the beam pattern 203 for antenna without reflector.

Directional or reflector antenna, in one form or another, have been used since the discovery of electromagnetic wave propagation in 1888 by Hertz. Although directional antennas may take many geometrical configurations, in practical applications the most widely used shapes are the plane, corner, and curved reflectors, especially the paraboloid. The simplest type of reflector is a plane reflector. FIG. 3 and FIG. 4 show top and side views of a radiation pattern for a finite flat sheet reflector placed at quarter wavelength d 307 behind the dipole antenna 304. The azimuth radiation pattern of the vertical omni dipole antenna 304 without reflector composes a circle 301, and the elevation radiation pattern of this antenna with flat sheet reflector composes the shape 401. The approximation formula for the calculation of azimuth pattern 302 for dipole antenna with infinite flat sheet reflector is as follows:

$E(?)=\sin(\beta d \cos ?)$, where $\beta=2p/?$, and ? is a wavelength.

Azimuth radiation patterns of direct, reflected, and diffracted rays 303, direct and diffracted rays 308, and diffracted rays 306 also may be calculated analytically but require more extensive calculations; the corresponding formulas may be found in Balanis, Constantine, *Antenna Theory: Analysis and Design*, John Wiley & Sons, Inc. (1997).

To improve the collimation of the radiation pattern in the forward direction, the geometrical shape of the flat reflector must be changed in the way to prohibit radiation in the back and side directions. One configuration, which achieving this goal is a combination of two flat reflectors joined so as to form a corner. Because of the simplicity of such construction, the corner reflector found many applications. FIG. 5 and FIG. 6 show top and side views of a radiation pattern for a 90-degree corner reflector placed at quarter wavelength behind the dipole antenna 505, 604. The azimuth radiation pattern of the vertical omni dipole antenna 505 without reflector composes a circle 501, and the elevation radiation pattern of this antenna with a 90-degree reflector composes the shape 504, 502. Azimuth radiation patterns of direct and reflected rays 504, and diffracted rays 502 depend on such parameters as the spacing distance between the vertex of the reflector and the dipole antenna, the aperture of the corner reflector, etc.

The overall radiation parameters of the antenna with reflector may be further improved if the structural configuration of the surface of the reflector is optimized for better reflection. For example, it is well known in geometrical optics that if a beam of parallel rays is incident upon a reflector with parabolic shape, then radiation will converge in a focal point. In the same manner, if a source of the radiation is placed in the focal point, then the rays reflected by a parabolic reflector will come out in parallel rays. FIG. 7 and FIG. 8 show top and side views of a radiation pattern for a parabolic reflector 702, 802 placed at quarter wavelength behind the dipole antenna 703, 803. The azimuth radiation pattern of the vertical omni dipole antenna 703 without reflector composes a circle 701, and the elevation radiation pattern of this antenna with a parabolic reflector composes the shape 704. In the case of the circular parabolic reflector placed at quarter wavelength behind the dipole antenna, the approximation formula for the calculation of the width W of the main lobe half-power point is W=58°/(D/?), and the width WN of the main lobe between nulls is WN=140°/(D/?), where D is a diameter of the circular mouth of the reflector, and ? is a wavelength. The directive gain G of the antenna with parabolic reflector may be calculated with good approximation by the formula: G=4 p AK/?$^2$, where A is an actual area of the mouth of the parabolic antenna; K is a correction factor of the order of 0.5–0.7 to compensate the non-uniform distribution of energy across the aperture due to tapering of the field; and ? is a wavelength.

A general concept of antenna reflectors and many particular applications have been discussed in a number of U.S. patents and publications.

The U.S. Pat. No. 4,663,632 "Extendable directional dipole antenna" discloses an extendable directionally adjusted dipole antenna suitable for use with motor vehicles. The antenna includes a vertical column having an extendable dipole arrangement at its upper end utilizing flexible actuators associated with a pair of reels where the actuators and associated telescoping antenna assemblies are simultaneously extended and retracted. An operating shaft for rotating the reels extends through the column and either manual or electric means rotate the shaft. The column is rotatable for directional adjustment, and under manual control the shaft extends through the vehicle roof permitting interior adjustments.

The U.S. Pat. No. 4,983,988 "Antenna with enhanced gain" discloses a combination of the plurality of vertically-polarized, omni-directional antennae having a reflector added to each one to limit the horizontal beamwidth to 90 degree and increase the gain to 16 dB. By utilizing four antennae and utilizing power combining hybrids to connect each of the two opposed antennae together, excess gain over a 10 dB omni-directional system will be obtained. The vertical beam width and physical height of the antenna are preserved with the increase in gain at the cost of an additional antenna complexity.

The U.S. Pat. No. 5,389,941 "Data link antenna system" discloses an antenna that employing the back radiation of a crossed-dipole to illuminate a parabolic cylindrical reflector. The crossed dipole is supported by a feed network mast, which simplifies the feed network and eliminates the need for other supporting structure and its electrical blockage. To provide an omni-directional radiation coverage, four of these antennas are located at the four quadrants, each covering one quadrant in the azimuth direction. The RF signal is fed through a single switch to the selected antenna to be radiated to the desired direction.

The U.S. Pat. No. 5,469,181 "Variable horizontal beam width antenna having hingeable side reflectors" discloses a broadband directional antenna having a central reflector plate, a dipole and at least one side reflector panel. The dipole is arranged on the central reflector plate for radiating a radio frequency signal, including a binary feed network having a microstrip transmission line and a collinear array of radiating elements. The side reflector panel is hinged to the central reflector plate for adjusting the horizontal radiation beamwidth of the radio frequency signal.

The U.S. Pat. No. 5,532,707 "Directional antenna, in particular dipole antenna" discloses a directional dipole antenna that is designed comparatively simply, and has improved electrical properties. It is provided that the symmetrical part of the antenna is made from the material of the reflector cut from the remaining material of the reflector wall, except for a connecting segment, which is cut preferably in the region of the immediate connecting point with the remaining material of the reflector wall and bent out relative to the plane of the reflector wall.

The U.S. Pat. No. 5,867,130 "Directional center-fed wave dipole antenna" discloses a directional center-fed half wave dipole antenna is constructed from a multilayer substrate having dipole antenna elements disposed on opposite surfaces of the multilayer substrate. An energy reflector is disposed on at least one side of the substrate and positioned adjacent to the dipole antenna elements that are fed by a center feed member that has a tapered width so as to provide the necessary impedance matching. A ground plane is disposed within the multilayer substrate, the elements of which are positioned on both sides of the center feed element.

The U.S. Pat. No. 6,198,460 "Antenna support structure" discloses an antenna support structure for at least three directional antenna sub-systems that can be planar antenna arrays. The antenna support structure comprises at least four panels adapted to support respectively one of the antenna sub-systems. The first two panels include a main panel and at least three secondary panels respectively adjacent to the main panel. The secondary panels can be respectively attached by hinge means to the main panel. In addition, the secondary panels can be individually adjusted in a predetermined angle to the main panel. The antenna support structure according to the invention can be particularly used in combination with wide-band printed dipole antennas for microwave and millimeter-wave applications.

SUMMARY OF INVENTION

Briefly, and in general terms, the present invention permits a dipole antenna to be used as an adjustable directional antenna. The beam direction of the antenna can be changed by rotating the reflector about the Y-axis and/or adjusting the reflector about X axis and Z-axis. This will allow the user to fine tune the antenna to meet new or unforeseen coverage issues. The reflector provides gain in the reflected direction. The plurality of the of the reflector's shapes is disclosed (flat, curved).

It is therefore an object of the present invention to provide a novel structural configuration of antenna reflector system for controlling an antenna gain in the predetermined way.

The novel features which are considered as characteristics for the invention are set forth in particular in the appended claims. The invention itself, however, both as to its construction and its method of operation, together with additional objects and advantages thereof will be best understood from the following description of specific embodiments when read in connection with the accompanying drawings.

DETAILED DESCRIPTION

Figure 9:
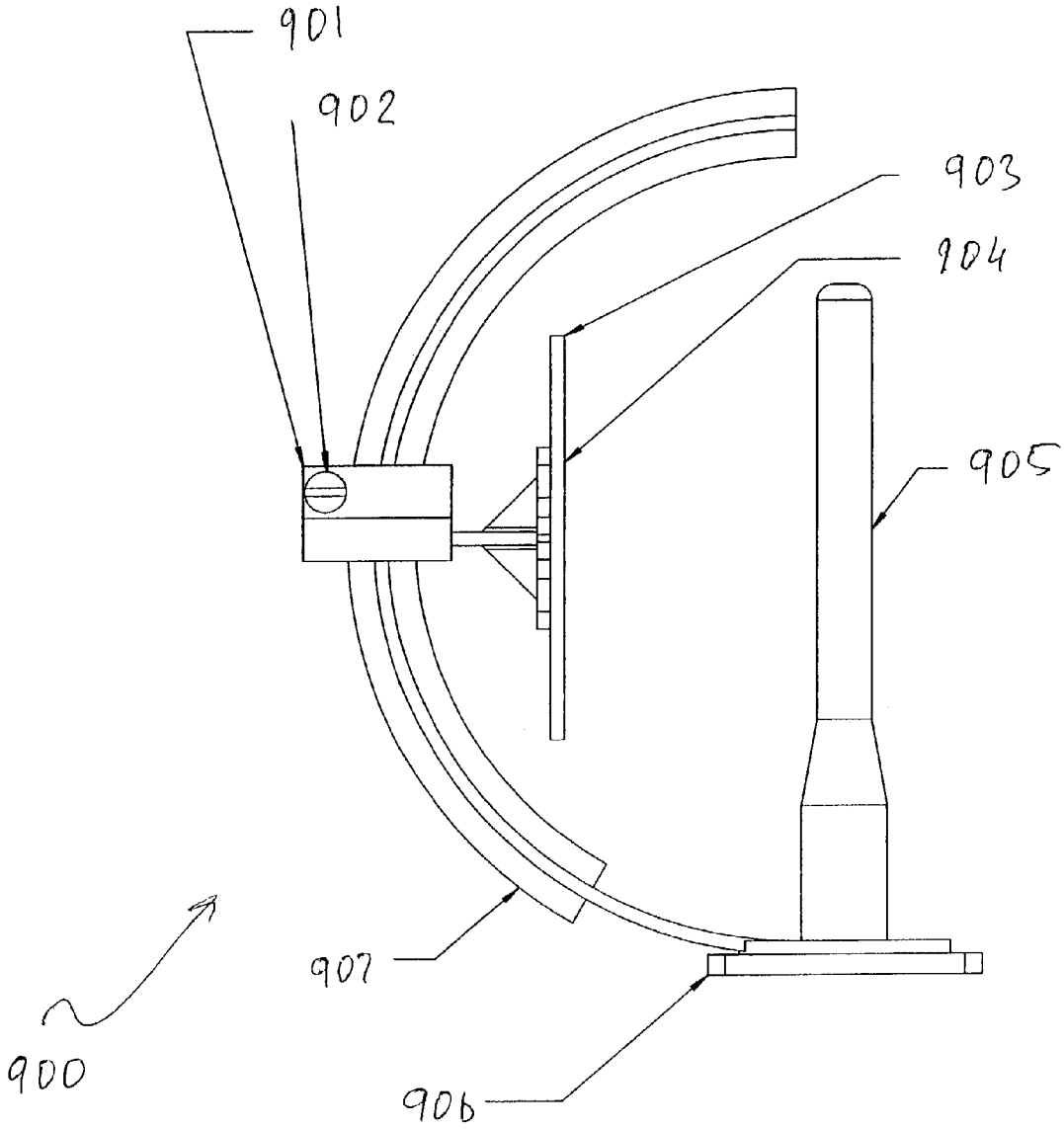
FIG. 9 is showing a simplified schematic of a side view of adjustable flat sheet reflector system.
Figure 10:
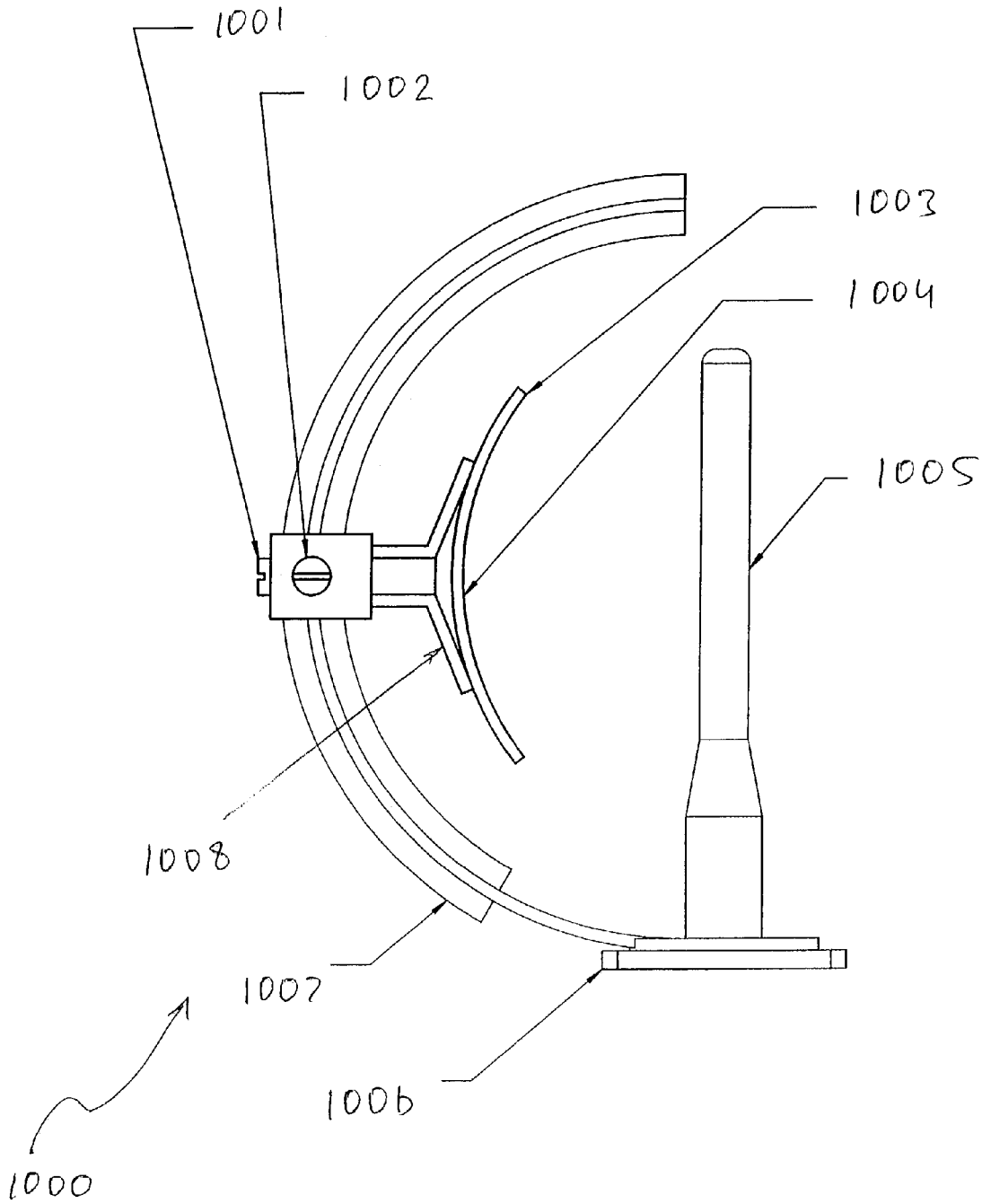
FIG. 10 is showing a simplified schematic of a side view of adjustable parabolic reflector system.
Figure 11:
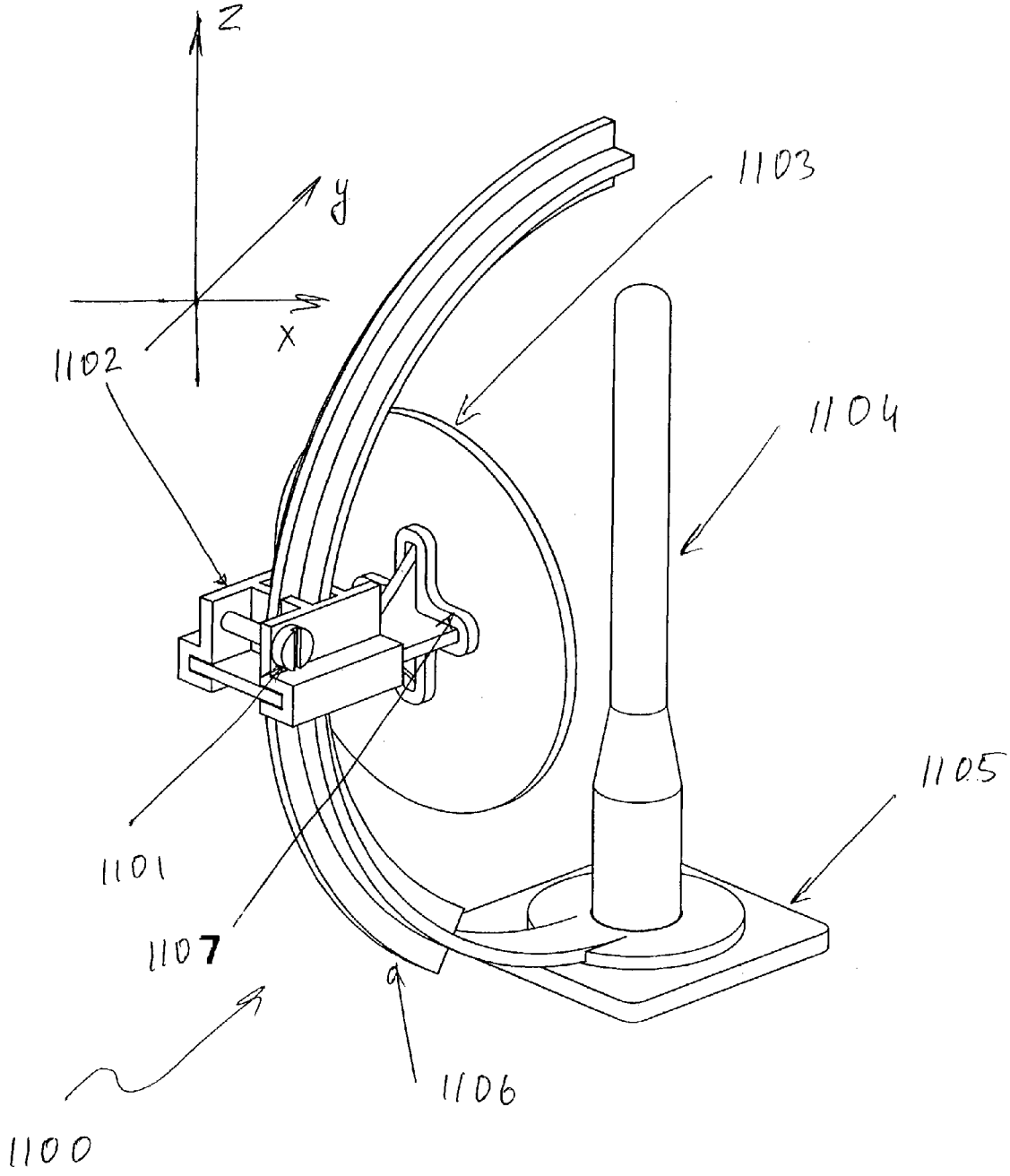
FIG. 11 is showing a simplified 3D schematic of a side view of adjustable reflector system.
Figure 12:
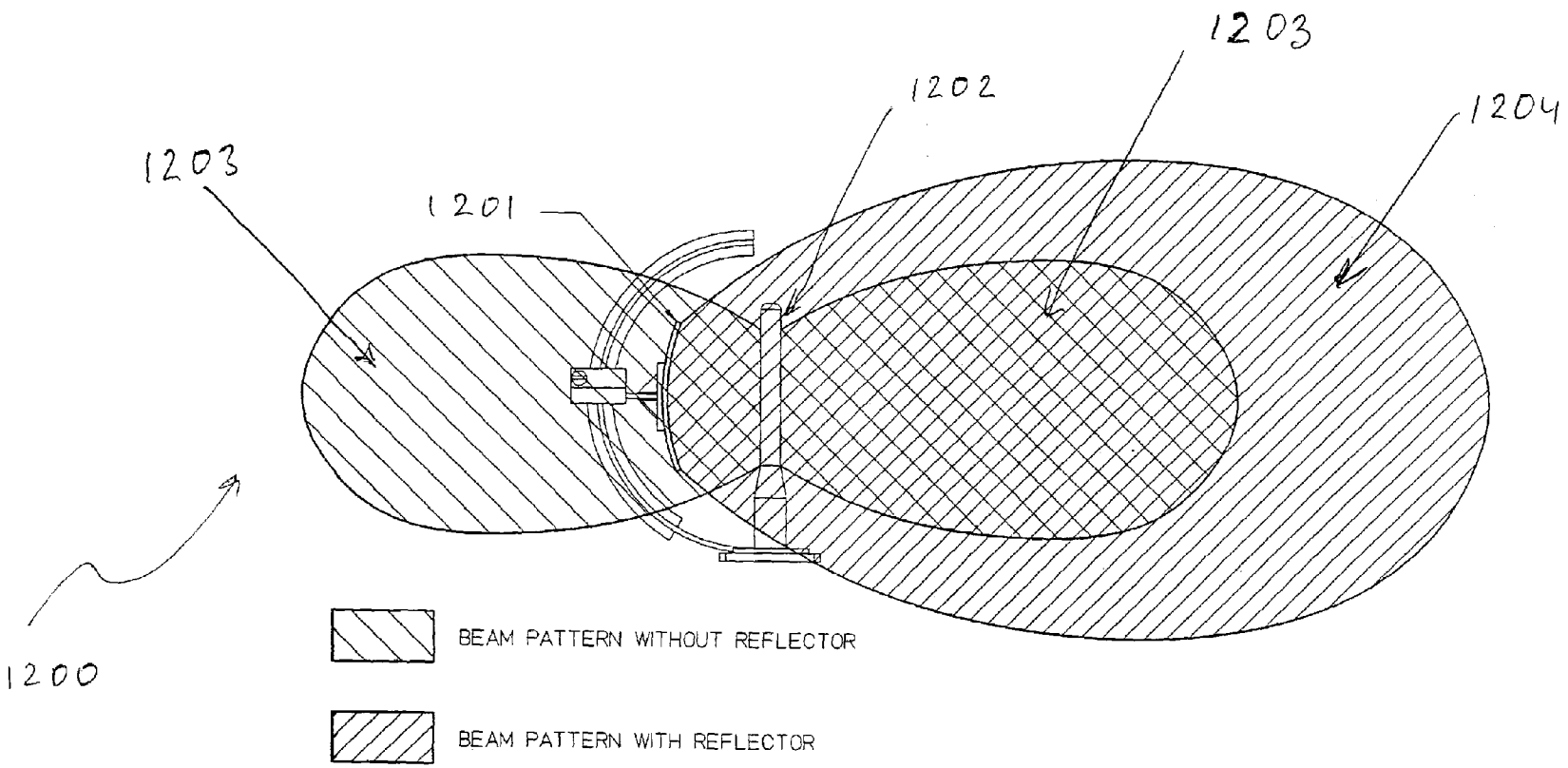
FIG. 12 is showing a simplified schematic of a side view of a beam pattern of a dipole antenna with a parabolic reflector and a beam pattern of the same dipole antenna without a reflector.

Traditional directional dipole antennas include the reflector, the primary energy source such as a dipole, and the feed network for feeding the RF energy to the primary source. Such directional antennas require specific supporting structure to suspend the dipole in appropriate position relative to the reflector surface. The present invention is directed to an adjustable reflector that can be mounted on a standard dipole antenna. The reflector can be arbitrary adjusted to provide a desired gain and radiation pattern of the dipole antenna. As illustrated in FIGS. 9, 10, and 11 an exemplary adjustable reflector system may consist of a clamp assembly 901, 1102 connected to adjustable arm 907, 1007, 1106. A locking screw 902, 1002, 1101 is securing a location of the clamp assembly on the adjustable arm. The adjustable arm is capable to rotate relatively a base 906, 1006, 1105 to change its orientation in relation to a dipole antenna 905, 1005, 1104. The base could have graduation marking for the indication of the direction of the beam. The dipole antenna is tightly connected to the base and has no moving parts. Furthermore, the clamp assembly is supporting a reflector of some geometrical configuration such as a flat reflector 903 or parabolic reflector 1003, for example. The orientation of the reflector relatively the dipole antenna defines a directional line of the radiated energy. On FIG. 12 is shown a beam pattern 1204 of a dipole antenna 1202 with a parabolic reflector 1201 and a beam pattern 1203 of the same dipole antenna without a reflector. As it is shown on the FIGS. 9, 10, and 11 the adjusting arm is curved in a way to control a radiation pattern not only in vertical orientation (up and down), but also to provide a desired inclination of the radiation pattern with predetermine angle.

To change a distance between a dipole antenna and a reflector, a reflector adjustment screw 1001, see FIG. 10, or any other device with capabilities to control the proximity between the reflector 1003 and the dipole antenna 1005 may be employed.

Figure 1:
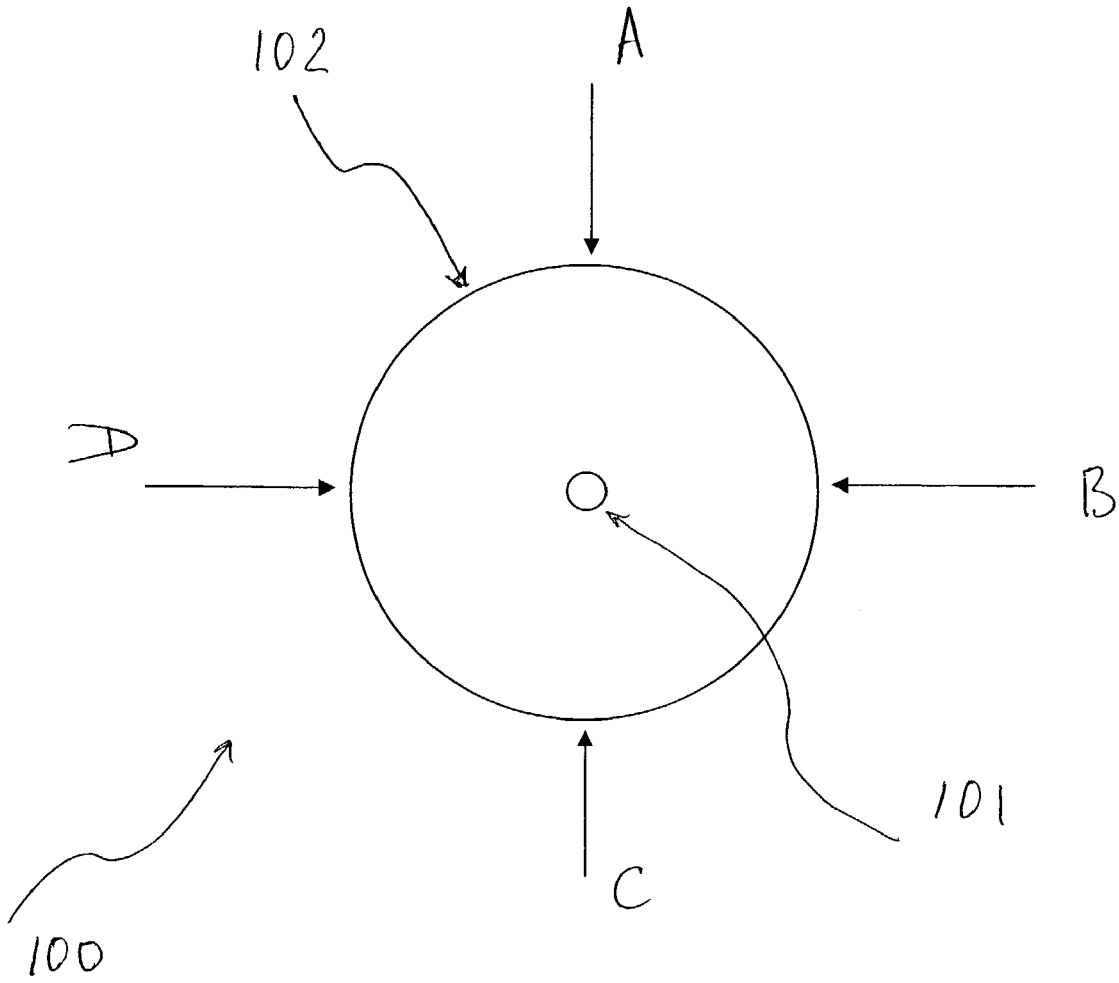
FIG. 1 is showing a simplified schematic view of the radiation pattern for an omnidirectional antenna with four cardinal signals.
Figure 2:
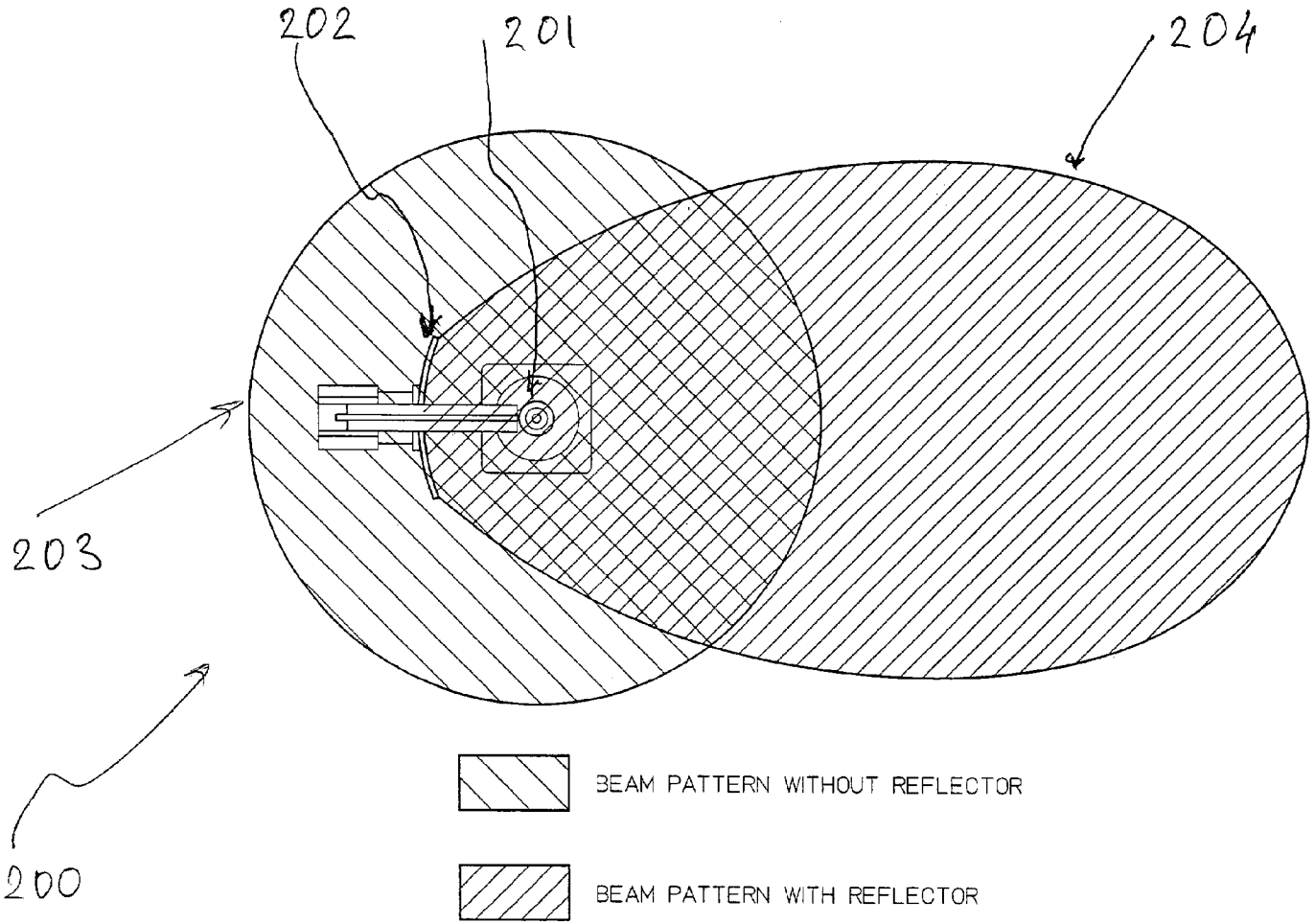
FIG. 2 is showing a simplified schematic view of the beam pattern for antenna with and without a reflector.
Figure 3:
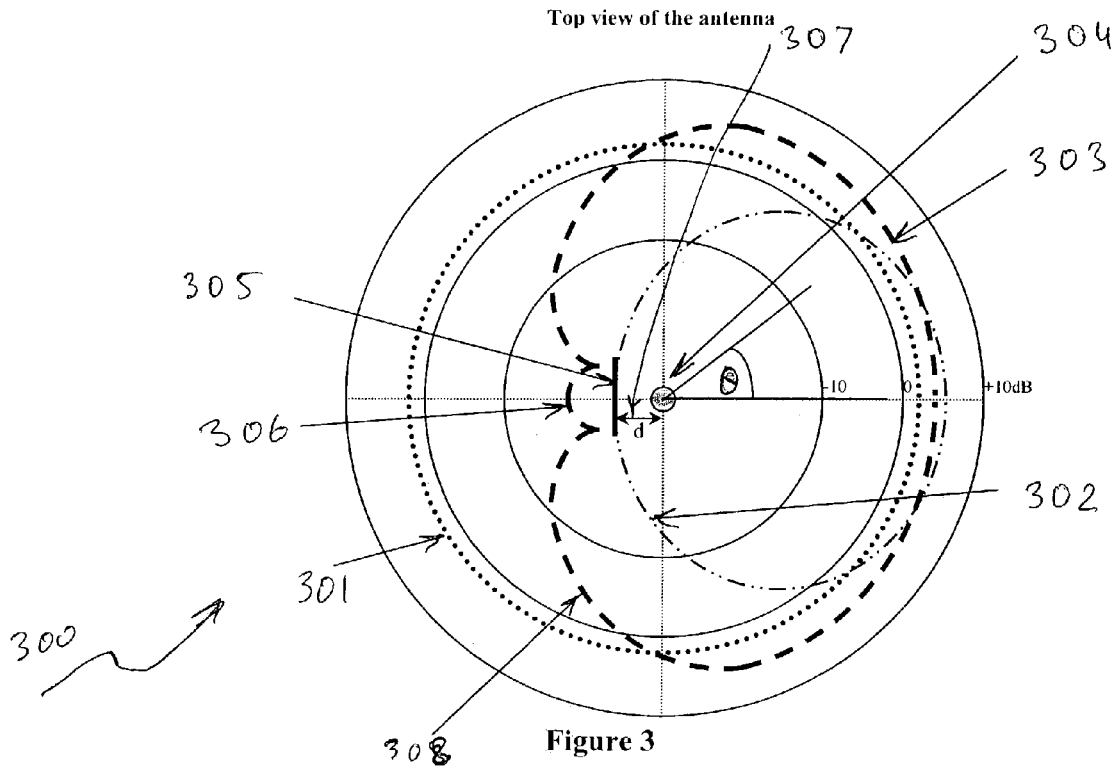
FIG. 3 is showing a simplified schematic of a top view of a radiation pattern for a finite flat sheet reflector placed at quarter wavelength behind the dipole antenna.
Figure 4:
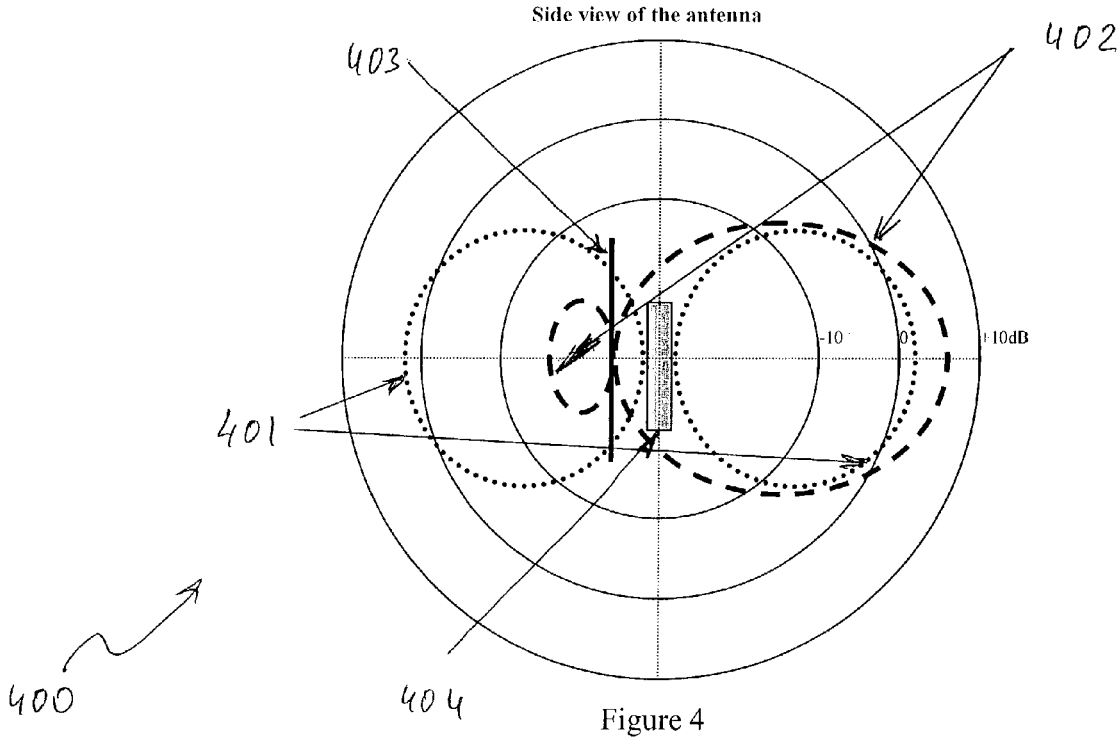
FIG. 4 is showing a simplified schematic of a side view of a radiation pattern for a finite flat sheet reflector placed at quarter wavelength behind the dipole antenna.
Figure 5:
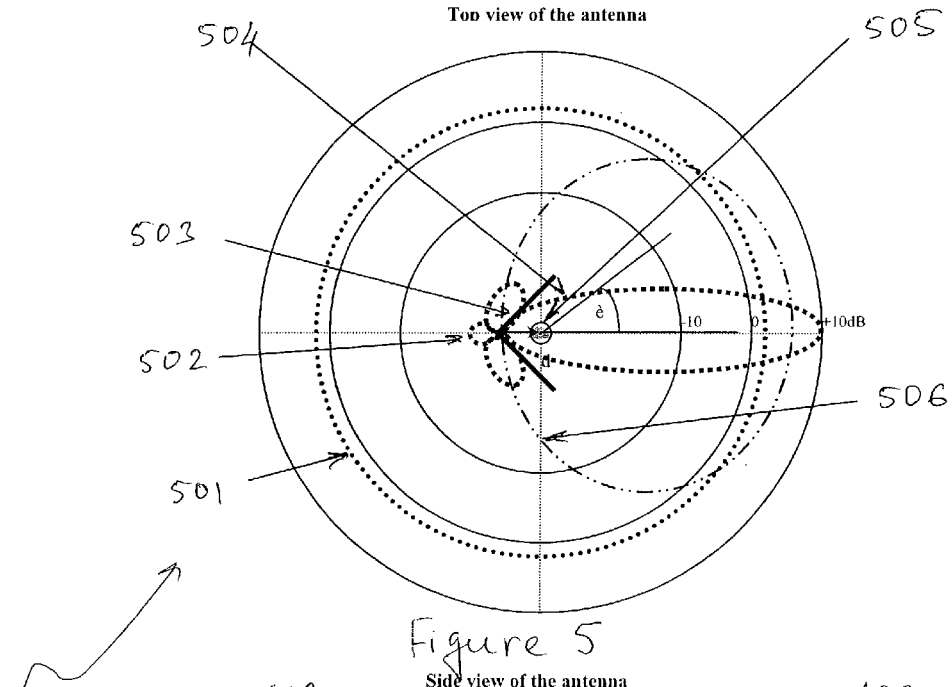
FIG. 5 is showing a simplified schematic of a top view of a radiation pattern for a 90-degree corner reflector placed at quarter wavelength behind the dipole antenna.
Figure 6:
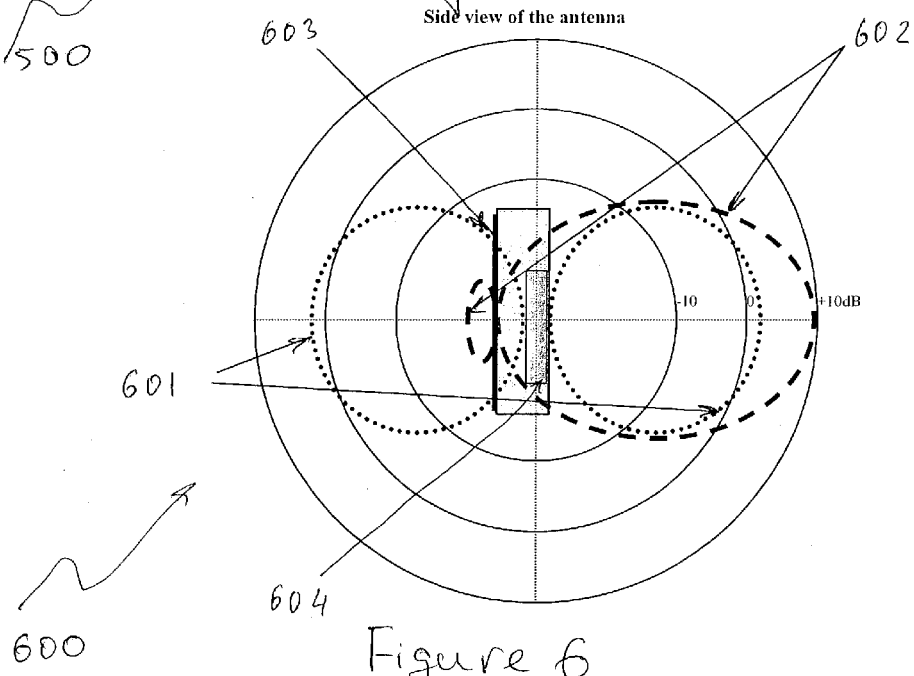
FIG. 6 is showing a simplified schematic of a side view of a radiation pattern for a 90-degree corner reflector placed at quarter wavelength behind the dipole antenna.
Figure 7:
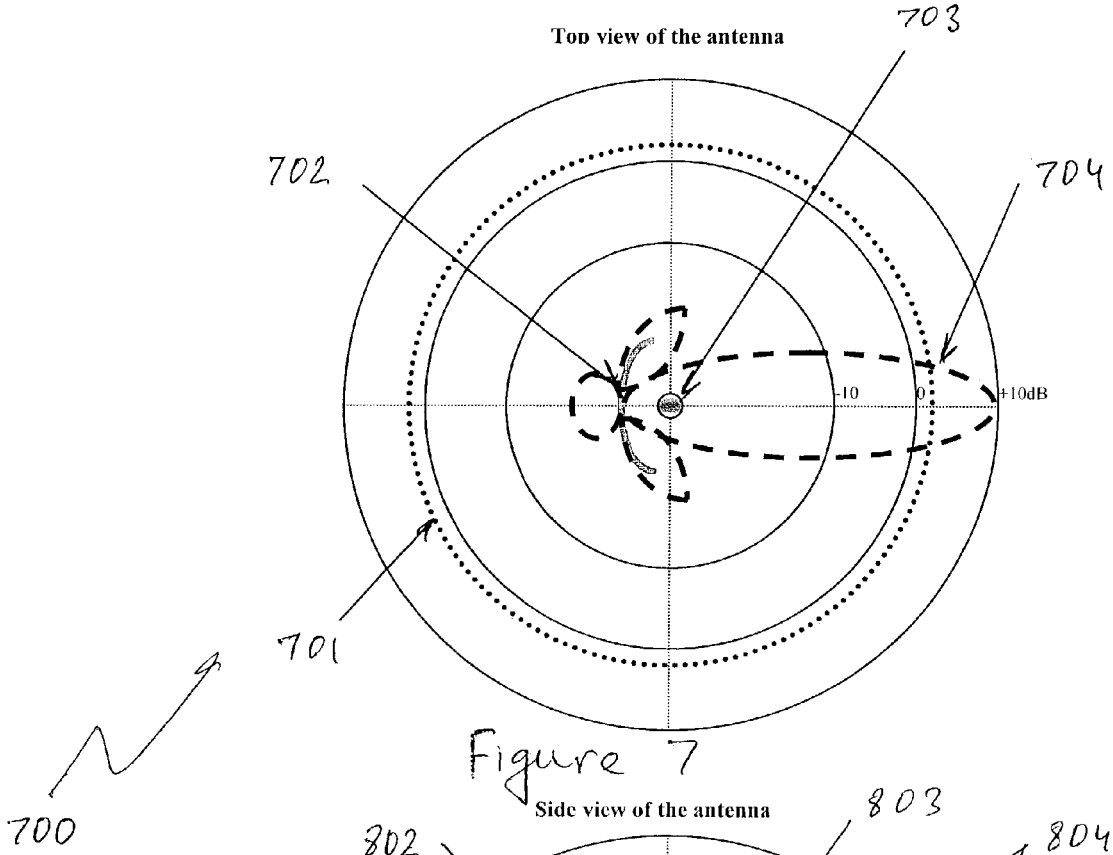
FIG. 7 is showing a simplified schematic of a top view of a radiation pattern for a parabolic reflector placed at quarter wavelength behind the dipole antenna.
Figure 8:
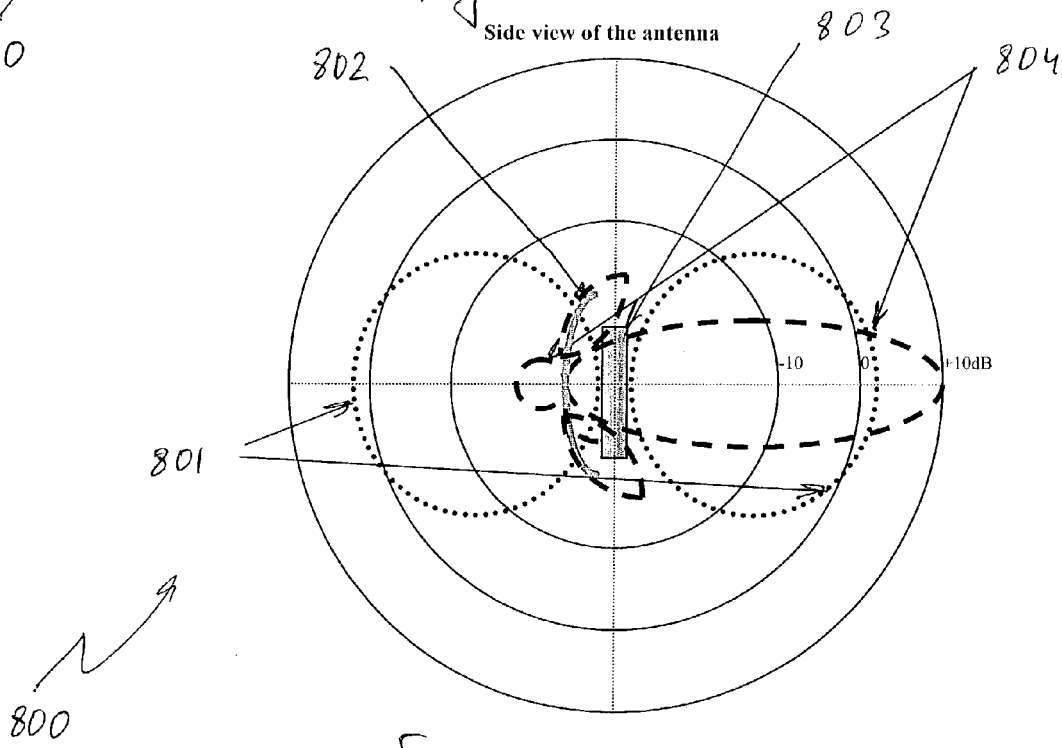
FIG. 8 is showing a simplified schematic of a side view of a radiation pattern for a parabolic reflector placed at quarter wavelength behind the dipole antenna.
Figure 13:
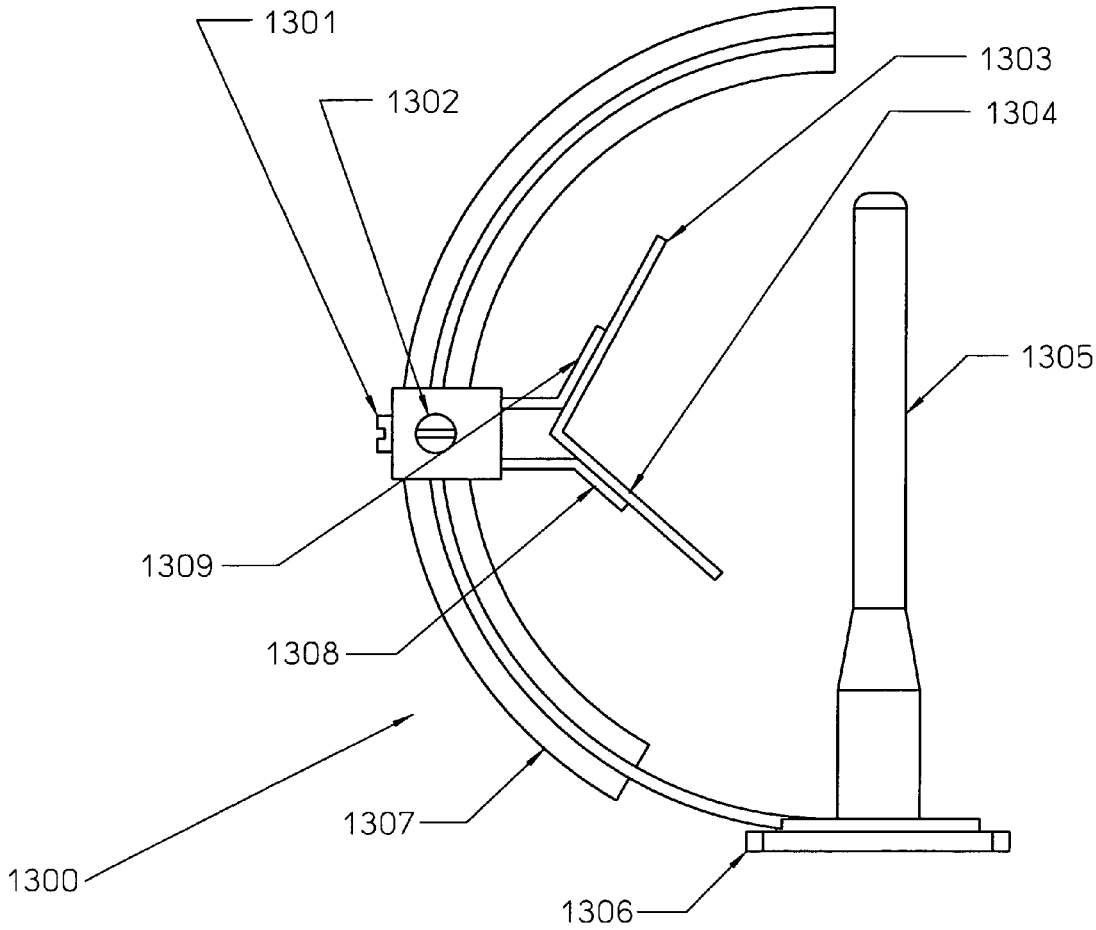
FIG. 13 is showing a simplified schematic of a side view of a corner reflector connected to reflector holders.

The curvature of the parabolic or angle reflector may be also controlled by a reflector holder 1008, 1107, see FIG. 10 and 11. Furthermore, the reflector may be composed from several segments such as corner reflector, see FIG. 5. The segments 1303, 1304 or corner reflector, see FIG. 13, are separately connected to reflector holders 1308, 1309 and could be independently controlled by said holders. As it was already stated, the configuration of the curvature of the reflector defines the collimation of the energy at a line that is parallel to the axis of the center of the reflector and its focal point. Therefore, if the reflector holder would be capable to shape the curvature of the reflector in the particular form in accordance with the required antenna gain, then the reflector system would accommodate diversified requirements for different particular applications such as point-to-point communication with minimum interference effect, the multidirectional orientations communications, multi-channel multi-point communication system for bi-directional signal transmission and reception, etc.

Furthermore, the antenna reflector may be comprised of separate segments operationally connected together by holding hinges or screws to form a predetermined shape. The adjustment of the reflector shape can be done even remotely by rotating hinges or screws that moved by additional devices such as electromotor, solenoids, etc, which are well known in the art.

The antenna reflector could be made from a metal of a plastic material with a radio reflective coating. As an example of such coating is a metalized coating (aluminum, copper, etc.). There are no specific limitations on the plastic material except that the reflector possesses the desired characteristics in flexibility and durability, which might be different for particular applications.

The adjustable reflector system can be integrated and installed on portable or fixed mounted wireless devices such as hand-held computers, access points, printing devices, scanners, etc. As a practical matter, a comparable directional antenna would cost several times more than the adjustable reflector system.

It will be apparent to those skilled in the art that various modifications and variations can be made in the adjustable reflector schemes without departing from the spirit or scope of the present invention.

What is claimed is:

1. An adjustable reflector system, comprising:

an antenna reflector;

a reflector holder connected to said reflector;

a curved adjusting arm connected to said reflector holder;

a clamp assembly operationally connected to said curved adjusting arm and said reflector holder;

a base;

a dipole antenna operationally connected with said base;

wherein said base and said curved adjusting arm are operationally connected with each other.

2. An adjustable reflector system, comprising:

an antenna reflector;

a reflector holder connected to said reflector;

a curved adjusting arm connected to said reflector holder;

a clamp assembly operationally connected to said curved adjusting arm and said reflector holder;

a base operationally connected to said curved adjusting arm;

a reflector adjustment devise operationally connected to said reflector holder to control the proximity between said reflector and said curved adjusting arm;

wherein said reflector further comprising separated operationally connected segments forming an antenna reflector shape.

* * * * *